US009051775B2

(12) United States Patent
Kristensen et al.

(10) Patent No.: US 9,051,775 B2
(45) Date of Patent: Jun. 9, 2015

(54) WINDOW HAVING A SASH AND IMPROVED CONNECTION TO THE HINGE

(75) Inventors: Lars Kristensen, Østbirk (DK); Kristian Ørnsvig Nielsen, Hornsyld (DK); Peter Sønderkær, Horsens (DK)

(73) Assignee: VKR Holding A/S (DK)

( * ) Notice: Subject to any disclaimer, the term of this patent is extended or adjusted under 35 U.S.C. 154(b) by 0 days.

(21) Appl. No.: 13/138,418

(22) PCT Filed: Feb. 3, 2009

(86) PCT No.: PCT/DK2009/050031
§ 371 (c)(1),
(2), (4) Date: Oct. 25, 2011

(87) PCT Pub. No.: WO2010/088904
PCT Pub. Date: Aug. 12, 2010

(65) Prior Publication Data

US 2012/0137607 A1 Jun. 7, 2012

(51) Int. Cl.

| | |
|---|---|
| ***E05D 7/00*** | (2006.01) |
| ***E06B 3/66*** | (2006.01) |
| ***E04D 13/035*** | (2006.01) |

(Continued)

(52) U.S. Cl.
CPC ..... *E06B 3/6621* (2013.01); *E04D 13/0354* (2013.01); *E05D 5/0246* (2013.01); *E05D 9/005* (2013.01); *E06B 3/025* (2013.01); *E06B 3/26345* (2013.01); *E06B 3/303* (2013.01);
(Continued)

(58) Field of Classification Search
CPC ..... E06B 3/66; E06B 3/025; E05D 5/0246; E04D 13/0354
USPC ..... 49/400, 401, 381, 501
See application file for complete search history.

(56) References Cited

U.S. PATENT DOCUMENTS

| | | | | |
|---|---|---|---|---|
| 1,301,737 | A | 4/1919 | Pierce | |
| 1,713,555 | A * | 5/1929 | Reuter | 49/401 |

(Continued)

FOREIGN PATENT DOCUMENTS

| | | |
|---|---|---|
| BE | 854963 | 9/1977 |
| CH | 369 277 A | 5/1963 |

(Continued)

OTHER PUBLICATIONS

English language Abstract of Japanese patent document No. 2002353714, 1 page.

(Continued)

*Primary Examiner* — Katherine Mitchell
*Assistant Examiner* — Abe Massad
(74) *Attorney, Agent, or Firm* — Merek, Blackmon & Voorhees, LLC

(57) ABSTRACT

The window for a building structure has a window frame (3), a sash (2) and a pane (1) including at least one sheet of glass or other glazing material. The sash (2) is moveable relative to the frame (3) by means of a hinge connection including a set of frame hinge parts (32) and a set of sash hinge parts (22). The sash (2) carrying the pane (1) includes at least a first element (4) surrounding the pane (1) and formed as a moulded border element which at least partially encases an edge of the pane (1). The first element (4) has at least one functional face to which the set of sash hinge parts (22) of the hinge connection is adapted to be connected. The sash (2) may include further elements (5, 6, 7, 8) for insulating, covering and/or aesthetical purposes.

15 Claims, 8 Drawing Sheets

(51) Int. Cl.

| | |
|---|---|
| ***E05D 5/02*** | (2006.01) |
| ***E06B 3/02*** | (2006.01) |
| *E05D 9/00* | (2006.01) |
| *E06B 3/263* | (2006.01) |
| *E06B 3/30* | (2006.01) |
| *E06B 7/14* | (2006.01) |

(52) U.S. Cl.

CPC ..... *E06B 3/306* (2013.01); *E06B 3/6625* (2013.01); *E06B 7/14* (2013.01); *E05Y 2900/148* (2013.01)

(56) References Cited

U.S. PATENT DOCUMENTS

| | | | | |
|---|---|---|---|---|
| 1,796,242 | A * | 3/1931 | Cooper | 49/401 |
| 1,909,875 | A | 5/1933 | Lundgaard | |
| 1,947,736 | A | 2/1934 | Potter | |
| 1,961,352 | A | 6/1936 | Hall | |
| 2,050,733 | A | 8/1936 | Ross | |
| 2,205,522 | A | 6/1940 | Fix | |
| 2,626,434 | A * | 1/1953 | Ike | 49/400 |
| 2,781,111 | A | 2/1957 | Kunkel | |
| 2,866,527 | A | 12/1958 | Schilling | |
| 3,299,591 | A | 1/1967 | Woelk | |
| 3,308,582 | A * | 3/1967 | Bakke | 49/383 |
| 3,665,661 | A | 5/1972 | Beckerer | |
| 4,024,690 | A | 5/1977 | Collins et al. | |
| 4,205,104 | A | 5/1980 | Chenel | |
| 4,314,424 | A * | 2/1982 | Gordon et al. | 49/400 |
| 4,495,726 | A * | 1/1985 | Lindstrom | 49/401 |
| 4,563,846 | A | 1/1986 | Webb | |
| 4,570,399 | A | 2/1986 | Wentink | |
| 4,676,026 | A * | 6/1987 | Schreiner | 49/501 |
| 4,712,287 | A | 12/1987 | Johnston | |
| 4,822,649 | A | 4/1989 | Canuad et al. | |
| 4,830,038 | A | 5/1989 | Anderson et al. | |
| 4,909,875 | A | 3/1990 | Canuad et al. | |
| 4,951,927 | A | 8/1990 | Johnston et al. | |
| 5,038,537 | A * | 8/1991 | Frambach | 52/207 |
| 5,061,531 | A * | 10/1991 | Catalano | 428/34 |
| 5,081,793 | A * | 1/1992 | Mauro | 49/501 |
| 5,111,618 | A | 5/1992 | Kaspar et al. | |
| 5,300,346 | A | 4/1994 | Tamura et al. | |
| 5,355,625 | A * | 10/1994 | Matsuoka | 49/400 |
| 5,410,846 | A * | 5/1995 | Frambach | 52/204.5 |
| 5,687,518 | A * | 11/1997 | Endo et al. | 52/204.1 |
| 5,784,839 | A * | 7/1998 | LaVanway | 52/204.1 |
| 6,138,341 | A | 10/2000 | Barroero et al. | |
| 6,216,417 | B1 | 4/2001 | Morin et al. | |
| 6,245,396 | B1 | 6/2001 | Nogami | |
| 6,572,355 | B1 | 6/2003 | Bauman et al. | |
| 6,837,022 | B2 | 1/2005 | Ito | |
| 6,979,041 | B2 | 12/2005 | May et al. | |
| 7,546,711 | B2 * | 6/2009 | Salzer | 52/204.5 |
| 8,484,916 | B2 | 7/2013 | Farag | |
| 8,720,135 | B2 | 5/2014 | Sonderkaer et al. | |
| 2003/0072899 | A1 | 4/2003 | Compton et al. | |
| 2003/0200718 | A1 | 10/2003 | Ito | |
| 2005/0217798 | A1 | 10/2005 | Sugiyama et al. | |
| 2006/0096539 | A1 | 5/2006 | Kawasaki et al. | |
| 2009/0277111 | A1 * | 11/2009 | Albrecht et al. | 52/213 |
| 2010/0199591 | A1 | 8/2010 | Sonderkaer et al. | |
| 2010/0205879 | A1 | 8/2010 | Sonderkaer et al. | |
| 2010/0205881 | A1 | 8/2010 | Sonderkaer et al. | |
| 2011/0047881 | A1 * | 3/2011 | Bjorn et al. | 49/399 |
| 2012/0137607 | A1 | 6/2012 | Kristensen et al. | |

FOREIGN PATENT DOCUMENTS

| | | | | |
|---|---|---|---|---|
| CN | 101258297 | | 9/2006 | |
| CN | 2864315 | | 1/2007 | |
| DE | 1945291 | | 5/1971 | |
| DE | 2342607 | | 4/1974 | |
| DE | 3708912 | | 9/1987 | |
| DE | 9110698 | | 11/1991 | |
| DE | 9110698 | | 1/1992 | |
| DE | 4325119 | | 2/1995 | |
| DE | 4337702 | | 5/1995 | |
| DE | 4427402 | | 2/1996 | |
| DE | 296 07 923 | U1 | 8/1996 | |
| DE | 19640551 | | 4/1998 | |
| DE | 19642175 | | 4/1998 | |
| DE | 10059849 | | 5/2001 | |
| DE | 20304015 | | 5/2003 | |
| DE | 20218215 | | 4/2004 | |
| DE | 202004009269 | | 8/2004 | |
| DE | 102004041533 | | 3/2006 | |
| DE | 102004049120 | | 4/2006 | |
| DE | 102006010646 | | 10/2006 | |
| EP | 0384462 | | 8/1990 | |
| EP | 384482 | A * | 8/1990 | |
| EP | 0 733 146 | B | 6/1997 | |
| EP | 1038083 | | 9/1998 | |
| EP | 1136644 | | 9/2001 | |
| EP | 1655443 | | 5/2006 | |
| EP | 1873323 | | 6/2006 | |
| EP | 1681399 | A2 * | 7/2006 | |
| EP | 1 691 000 | A | 8/2006 | |
| FR | 1381137 | | 12/1964 | |
| FR | 2340439 | | 9/1977 | |
| FR | 2514057 | | 4/1983 | |
| FR | 2666636 | | 3/1992 | |
| FR | 2717854 | | 9/1995 | |
| FR | 2843161 | | 2/2004 | |
| FR | 2845415 | | 4/2004 | |
| GB | 1132070 | | 10/1968 | |
| GB | 1417342 | | 12/1975 | |
| GB | 2 005 330 | A | 4/1979 | |
| GB | 2077834 | | 12/1981 | |
| GB | 2245861 | | 1/1992 | |
| JP | 9232846 | | 1/1992 | |
| JP | 10276023 | | 10/1998 | |
| JP | 2002353714 | | 12/2002 | |
| JP | 2003321258 | | 11/2003 | |
| NL | 7503816 | | 10/1976 | |
| WO | 96/24963 | | 8/1996 | |
| WO | WO 9928581 | A1 * | 6/1999 | |
| WO | WO0125581 | | 4/2001 | |
| WO | 02/057564 | | 7/2002 | |
| WO | 2006/133298 | | 12/2006 | |
| WO | WO 2007/028392 | A | 3/2007 | |
| WO | WO 2009018831 | A1 * | 2/2009 | E06B 3/66 |

OTHER PUBLICATIONS

English language Abstract of Japanese patent document No. 10276023, 1 page.

English language Abstract of Japanese patent document No. 2003321258, 1 page.

* cited by examiner

WINDOW HAVING A SASH AND IMPROVED CONNECTION TO THE HINGE

BACKGROUND OF THE INVENTION

The invention relates to a window for a building structure, comprising a window frame, a sash and a pane including at least one sheet of glass or other glazing material, said sash being moveable relative to the frame by means of a hinge connection including a set of frame hinge parts and a set of sash hinge parts, said sash carrying the pane, said sash including at least a first element surrounding the pane and formed as a moulded border element which at least partially encases an edge of at least one sheet of said pane, said first element having at least one functional face.

When glazing vertical windows as well as roof windows the pane is usually secured to a glass-carrying frame, i.e. traditionally the sash, by means of glazing profiles fastened to the frame by means of screws. The pane is kept in place by means of glass spacers and glazing clips. Though it has proven very efficient this method suffers from a number of disadvantages, among others the large number of different parts needed for the glazing and the fact that the discontinuous support may cause potentially destructive strains on the pane, particularly when using a conventional glass sheet pane. This influences the lifespan of the pane with respect to breakage and failure in the sealing, the latter resulting in the formation of condensation in the space between the two sheets of glass constituting the pane.

One attempt at overcoming these deficiencies is disclosed in published European patent application No. EP 0 384 482 A2.

SUMMARY OF THE INVENTION

It is the object of the invention to provide a window, in which the manufacture is more cost-effective and flexible, and which provides a secure and reliable connection between the individual parts of the window.

This and further objects are achieved by a window of the kind mentioned in the introduction, which is furthermore characterized in that the set of sash hinge parts of the hinge connection is adapted to be connected to said first element at a functional face thereof.

By providing for connection of the sash hinge parts directly to the first element of the sash the window may be manufactured with the use of fewer parts than what is needed for conventional glazing, as there is thus no need for further structural elements for transmitting the load from the pane into the fixed building structure. By moulding the pane and the element required to fulfil the tasks of the sash in one operation, this design of the window allows for a particularly cost-effective and flexible manufacture, as the first element may be designed taking mainly or only structural considerations into account.

In a preferred embodiment, said sash includes at least one further element, said at least one further element being connected to the first element at a functional face. This provides for a great flexibility in designing and custom-making the sash to the demands made, for instance on individual markets, in order to fulfil regulations, architectonic traditions or consumer requirements with respect to insulating properties, appearance, protection against weather conditions etc.

In a further development of the preferred embodiment, said at least one further element includes a second element positioned on the inner side and/or internal side of the first element. The second element is thus the one visible from the interior, i.e. the inside of the building room in which the window is installed. The second element may thus be designed with any properties desirable, without having to take structural considerations into account. Additionally, the second element may have insulating properties to increase the overall thermal efficiency of the window.

In one embodiment, which is particularly advantageous as regards the insulating properties, said at least one further element includes an insulating element positioned on the outer side of the first element. As this further element is in general not visible from the interior, at least not in the closed or only slightly opened condition of the window, and does not necessarily contribute to the structural strength of the sash, a material for the insulating element may be chosen only to optimise the insulating properties of the window. In turn, this opens a considerably increased choice in materials, as most insulating materials have a low density and consequently a lower structural strength.

In yet another embodiment, said at least one further element includes an external element positioned on the external side of the first element. The external element may be formed as a traditional cover connected to the exterior functional face of the first element of the sash. The cover may provide additional shielding against the penetration of weathering to interior parts of the window, or may be chosen to adapt the window to the surroundings, for instance in cases where the window is utilised as a replacement window in an array of conventional windows.

In a further development, which is particularly applicable in areas requiring a high degree of insulation and soundproofing, said at least one further element includes an internal element positioned on the internal side of the first element, said internal element including a supplemental sheet of glazing material.

The window may be any kind of window applicable within the building area, i.e. fulfilling the particular requirements to windows to be installed in fixed constructions, including any geometrical configuration. In a preferred embodiment, said sash comprises a top piece, a bottom piece and two side pieces, and wherein said set of sash hinge parts is connected to the first element of the side pieces of the sash.

In one embodiment, each sash hinge part is integrally connected with the first element of the sash. Preferably, the integral connection is carried out in the same process step as the moulding of the first element to the pane, for instance by positioning the sash hinge parts at the appropriate places in the mould. Alternatively, the hinge parts may be connected integrally in any other manner.

Alternatively, each sash hinge part is adapted to be connected to a mounting fitting moulded into the first element of the sash. This makes it possible to utilize the same pane-sash constellation in a number of applications having different requirements as to the particular design of the hinge.

Thus, the hinge connection may include a traditional pivot hinge for positioning at a position along the side pieces of e.g. a roof window, the hinge of a top-hung window, pivot hinges included in special arrangements, for instance positioned farther away from the light-admitting aperture, or on an intermediate frame allowing pivoting of a top-hung window.

Although the first element of the sash is only required to transmit the forces via the hinge connection, further arrangements including load-transmission may be applicable. In one embodiment, the top piece of the sash is provided with a locking assembly. In another embodiment, the bottom piece of the sash is provided with operating means for opening, positioning and/or closing of the sash relative to the window frame.

In windows adapted for the building area, condensation may arise, which must be avoided or alleviated. In one embodiment, the pane comprises at least two sheets, the first element encasing the edges of both sheets of the pane substantially in full, and wherein draining means are provided.

The drain may include a channel extending from the edge of the pane to the outer side of the first element of the sash. Alternatively, the drain may include a gel located in a space within the first element of the sash. As a further alternative, a circumferential drain extending along the edge of the pane and within the first element of the sash.

In one embodiment, in which the insulating properties of the window are increased, the window frame is provided with a supplemental insulating frame.

Although the connection between the pane and the sash, viz. the first element moulded to the edge of the pane, is reliable and sufficient for most applications, taking modern materials and manufacturing processes into account, there may arise a need or desire for supplemental protection against the risk of loosening of the pane with respect to the sash. In one embodiment, which takes care of these considerations, a support is provided in the first element of the sash, said support being moulded into the first element and overlapping the external side of the pane slightly. By means of the support, a mechanical securing of the pane is achieved.

In windows, in which the sash comprises a top piece, a bottom piece and two side pieces, the support is provided on at least two opposite side pieces of the sash or at the top piece and the bottom piece of the sash. By positioning the support at least on sash pieces opposite each other, or even on all four pieces, a positive engagement between the pane and the sash is ensured at all times.

The support may be formed of any suitable material, which is preferably fireproof. In one preferred embodiment, the support is connected to the set of sash hinge parts. In this manner, a connection between the pane and the window frame via the hinge connection is maintained, even in the case of fire entailing partial or full melt-down or at least deterioration of the structural properties of the sash.

In a further development of the preferred embodiment, in which at least one further element is connected to the first element, each said further element is advantageously detachably connected to first element. In this manner, the parts of the sash may be exchanged for new parts, or extra elements may be mounted subsequently, for instance for maintenance purposes.

In the following, the invention will be described in further detail with reference to the drawing in which:

DETAILED DESCRIPTION OF THE PREFERRED EMBODIMENTS

Figure 1:
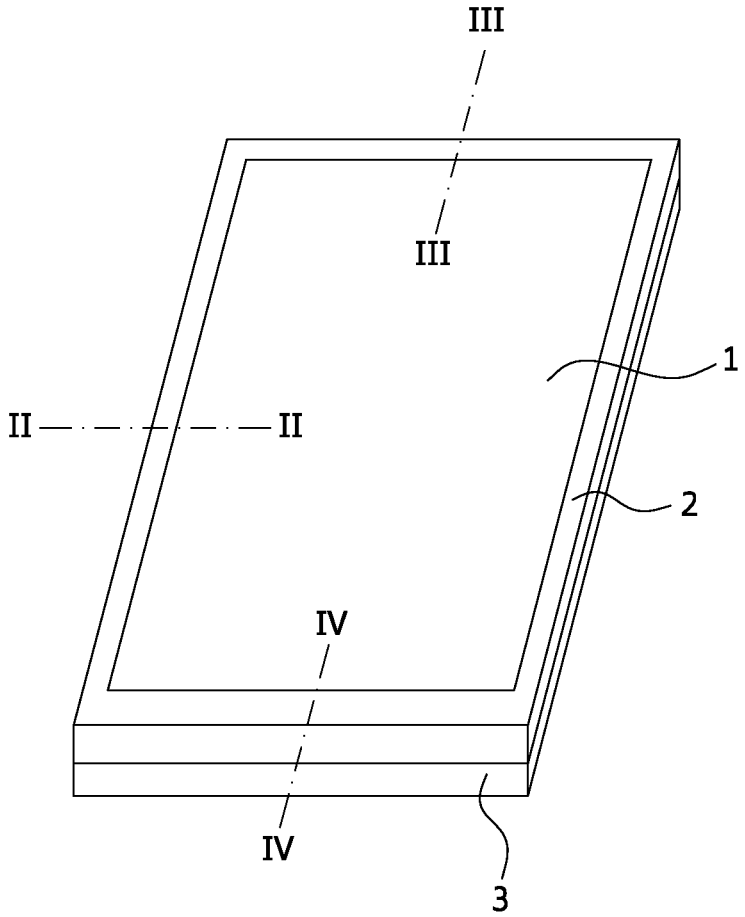
FIG. 1 is a perspective view of a window according to the invention.

A window according to the invention is shown in FIG. 1. The window comprises a pane element 1 (referred to as pane in the following), a sash 2 and a window frame 3 for installation in a building structure (not shown). The building structure may be any kind of suitable roof surface or a façade of a fixed construction. Thus, the window is a building window to be installed vertically or inclined in the façade or the roof of any residential, office or industrial building. The sash 2 is connected to the window frame 3 by means of a hinge connection defining a hinge axis, in a manner to be described in further detail below. The sash 2 comprises a top piece, a bottom piece and two side pieces, and the set of sash hinge parts is connected to the first element of the side pieces of the sash. In the following the side pieces, top piece and bottom piece of the sash and frame, respectively, will be denoted throughout by reference numerals 2 and 3, respectively.

Referring now in general to the embodiments of the window shown in FIGS. 2*a* to 2*g*, each window comprises a sash 2 including a first element 4 surrounding the pane 1 and formed as a moulded border element. In the embodiments shown in FIGS. 2*a* to 2*d*, the sash 2 includes a second element 5.

Figure 2A:
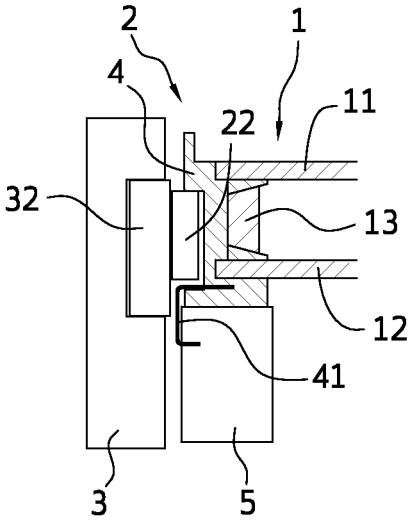
FIGS. 2*a* to 2*g* are cross-sectional views taken along the line II-II in FIG. 1 of different embodiments of the window shown in FIG. 1.
Figure 2B:
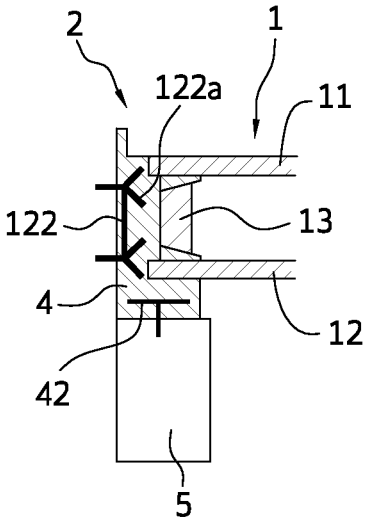
Figure 2C:
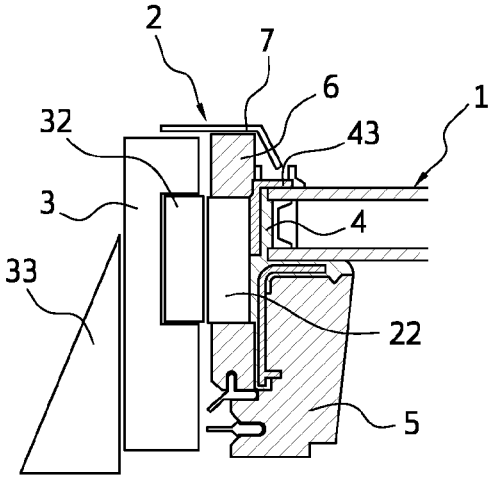

The first element or border element 4 creates a structural joint to the pane 1, thereby rendering the glazing profiles etc. formerly used redundant. In the embodiments shown in FIGS. 2*a* to 2*e*, the first element 4 surrounds the entire border of the pane and encases an edge of both sheets of the pane 1 on all four pieces of the sash 2, but it is to be understood that it may also be U-shaped surrounding the pane on three of its four sides or that separate elements may be used on each side leaving the corners of the pane free or connected to tailor-made corner pieces. Similarly it is to be understood that windows with other geometrical configurations, i.e. semi-circular or triangular, are also conceivable. In the embodiment of FIG. 2*f*, the first or border element 4 only surrounds the external sheet II of the pane 1, whereas in the embodiment of FIG. 2*g*, only one sheet exists, thus constituting the pane 1 itself.

The first element 4 is preferably made by moulding it directly on the pane 1, either with both sheets congruently or separately. If the pane 1 is a finished pane element comprising the predefined number of sheets (two, three, . . . ), the entire pane element is positioned in the mould. If, on the other side, the multi-sheet pane 1 is formed in two or more steps, then the first sheet 11 is attached to the first element 4 by the moulding process and the second sheet is then connected to the first sheet thereby forming a two-sheet pane 1. Further sheets may, if desirable, be connected in a corresponding manner. Subsequently, the space between the first element 4 and the edge of the pane may be sealed by caulking, cf. the description of FIG. 2*f* below. Polyurethane is a preferred moulding material. In principle, a pane module consisting of the pane 1 and the first element 4 thus forms the sash 2 itself and fulfils the function of a structural element bearing the loads affecting the window. The remaining element or elements of the sash 2 may therefore be formed with any desired properties as regards insulation, soundproofing, protection, covering, or even taking into account aesthetical considerations. Any suitable material, such as wood, plastic, polyurethane or polyurethane with a wooden core, can be used for the manufacture of the remaining elements of the sash 2.

The first element 4 may be produced by using any suitable moulding technique, but injection moulding, e.g. reaction injection moulding (RIM), is preferred. When using the RIM process, current-carrying components, plastic or metal components contributing to strength and stiffness, screws etc. may be embedded in the moulding material. Furthermore, the RIM process allows the integration of details such as sealings. Reaction injection moulding (RIM) is a process that is well known per se. During moulding, a two-component curing polyurethane is mixed in the mould. In the mould a pressure of approximately 6 to 10 bar is obtained during the curing process. The cured item is ready to be handled within approximately 45 to 60 seconds. During the RIM process itself the temperature of the material and the mould lies between 80 and 110° C. depending on the configuration of the mould and whether the polyurethane used is of the aromatic or the aliphatic kind. According to the kind of polyurethane used different Shore A hardness may be obtained. In the example, polyurethane having a cured hardness of 60-90 Shore A may be used.

It is of course also possible to perform the moulding in other ways, e.g. at higher temperature and/or pressure, which may be necessary when using other materials than polyurethane. Using a single-component material, which is injected into the mould without the need for mixing is another option.

As the unit formed by the first element or border element 4 as the substantial parts of the sash 2 functions as a structural member itself, a set of sash hinge parts 22; 122; 222 of the hinge connection is adapted to be connected directly to the first element 4 at a functional face thereof, viz. in the embodiment shown to the outer surface facing away from the light-admitting aperture covered by the pane 1. The hinge connection may be formed as any hinge connection suitable for openable windows. In the embodiment of FIGS. 2*a*, 2*c*, and 2*e*, the hinge connection may for instance formed as a traditional pivot hinge used in roof windows. One example of such a hinge connection is disclosed in Applicant's European patent No. 1038083. The corresponding set of frame hinge parts 32 is mounted in the window frame 3, preferably but not necessarily in a recess formed in the inner side of each of the window frame side pieces.

Figure 2D:
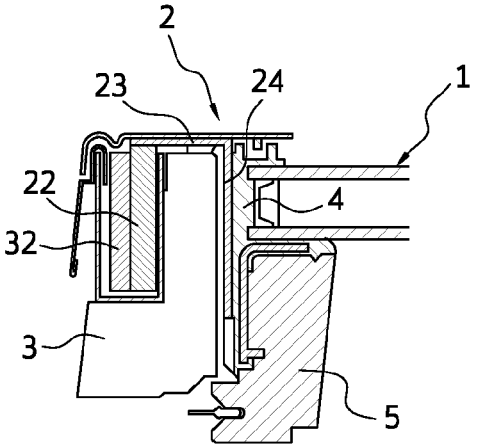

The embodiment of FIG. 2*d* shows a fourth embodiment of the window according to the invention and incorporating a hinge connection disclosed in Applicant's international application WO 2007/028392. Each frame hinge part 32 is secured to the surface of the window frame piece facing away from the sash piece or, alternatively, in a recess formed in an upper surface of the frame side piece, in which the side facing the surrounded aperture is substantially unaffected by the recess, and wherein the sash hinge part 22 is connected to the sash side piece 4 via a connecting piece spanning at least a part of the frame piece substantially crosswise to the longitudinal direction of the frame piece 3. In the embodiment shown, the connecting piece and the sets of frame and sash hinge parts constitute a substantially U shaped unit, in which a first leg of the U including or constituted by the sash hinge part 22 is substantially perpendicular to the hinge axis and projects into the recess or along the surface of the frame facing away from the surrounded aperture, where the centre of the U is substantially parallel to the hinge axis and spans a part of the frame piece 3, and where a second leg 24 of the U is secured to the sash, the centre leg 23 and second leg being formed by the connecting piece.

Figure 6C:
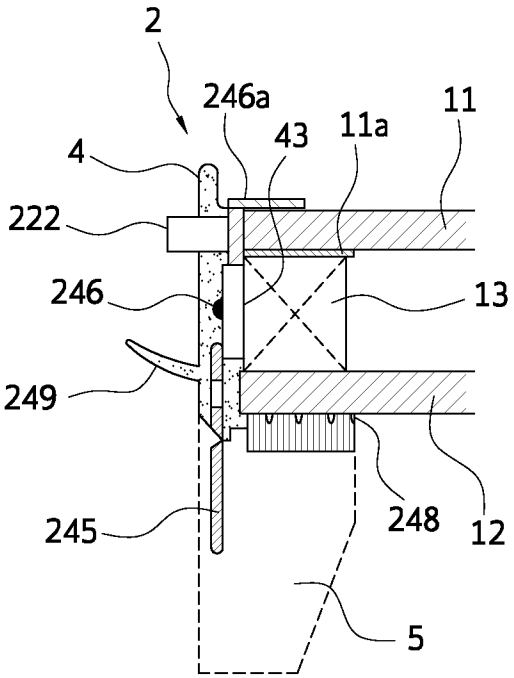
FIGS. 6*a* to 6*c* are cross-sectional views taken along the line VIVI in FIG. 5 of three different embodiments of the window shown in FIG. 5.
Figure 6B:
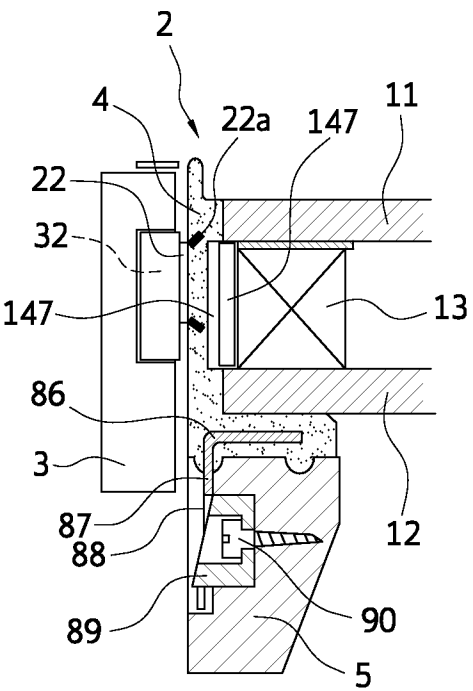

A further alternative embodiment of the hinge connection is shown in FIGS. 2*b* and 2*f*. Here, each sash hinge part is adapted to be connected to a mounting fitting 122 moulded into the first element 4 of the sash 2. This provides for a flexible choice of hinge connections, which may be of any kind suitable. In order to secure retention of the mounting fitting 122 into the first element 4 of the sash 2, anchoring means 122*a* are provided. The anchoring means 122*a* may be formed as flanges extending in various directions in any of the three dimensions, i.e. lengthwise along the sash side piece 2, transverse from the outer to the inner, and/or in the height direction, i.e. from the internal to the external. Correspondingly, the sash hinge part 22 of a traditional pivot hinge may be secured into the sash 2 by providing the sash hinge part 22 with anchoring means. Referring now to FIG. 6*b*, such anchoring means 22*a* are indicated in the sash side piece 2. The provision of anchoring means, which may be formed integrally with the mounting fitting and the sash hinge part itself, or as one or more separate elements connected to the hinge part, provides an additional security against unintentional de-attachment of the hinge from the sash.

In all of the above embodiments, the set of hinge parts of the hinge connection may be located at suitable opposite positions of for instance the side pieces of the window frame and sash, or at the top or bottom pieces, respectively, of the window frame and sash. Furthermore, the hinge axis being positioned arbitrarily along for instance the side pieces. In a traditional pivot window, the sets of hinge parts are positioned centrally; however, a position closer to the top piece or bottom piece is conceivable as well, for instance for the purpose of obtaining a larger available opening, if the window is to be used as a rescue exit.

In a not-shown embodiment, the sash is connected to the window frame by means of an intermediate frame connected to the window frame at the top piece window frame by means of an additional set of hinges, and wherein the sash is hingedly connected to the frame by means of said set of sash hinge parts, the set of frame hinge parts being mounted on said intermediate frame. In this manner, the window is of the top-hinged type having a hinge axis at or close to the top of the window. However, due to the intermediate frame, the sash is able to pivot for instance for cleaning purposes. Examples of this type of window are shown in for instance European patent applications 733146 and 1873323.

Figure 2G:
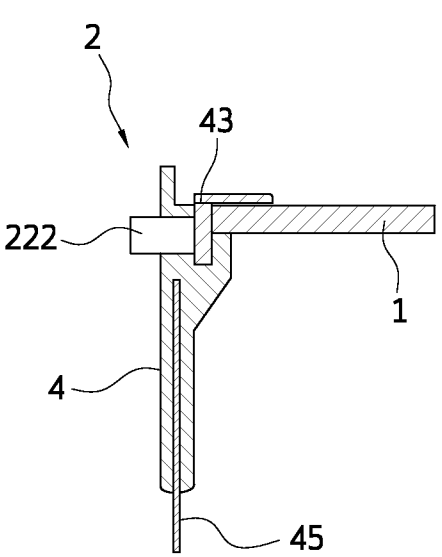
Figure 2F:
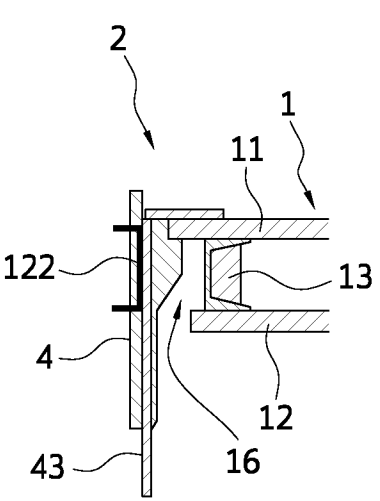
Figure 2E:
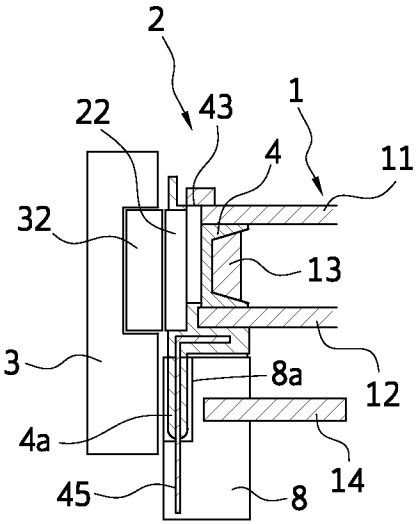

Eventually, the set of sash hinge parts may be formed as a simple pin 222 as shown in the embodiment of FIG. 2*g*. The pin 222 is moulded into the first element 4 and is adapted to be received in a corresponding aperture of a hinge fitting mounted to the frame, for instance centrally or at the top of the window frame.

FIGS. 2*a* and 2*b* show two different embodiments of the sash side pieces 2. The first or border element 4 is moulded around the pane 1 encasing it on the edge and interior faces. "Interior" in this respect denotes the direction, which in the installed position of the window points inwards into the building. At an interior functional face of the first element 4, a further element sash element in the form of second element 5 is attached. The second element 5 is shown as being of a rectangular configuration, but it is to be understood that more complex configurations may be necessary for carrying out any features desirable, for instance for achieving a water proof connection to the structure in which the window is mounted or to the surrounding window frame, for insulating considerations, or for aesthetical purposes.

A fitting 41, 42 is embedded in the first or border element 4 during its manufacture and is subsequently connected to the second element 5. When using a wooden or extruded second element 5, the fitting may be driven into the second element and when using a moulded second element 5, the fitting may be embedded therein during moulding. In the latter case an I-shaped fitting (not shown) may be used to thereby increase the draw out resistance.

If the adhesion of the first element 4 to the second element 5 is particularly strong and stable, the fitting 41, 42 may be left out entirely. This may be achieved by an appropriate priming of the area of attachment on the frame.

The use of a moulded sash comprising more elements in addition to the compulsory first element 4 provides a particularly secure connection, but it necessitates the use of a mould that is large enough to hold at least both the first element 4 of the sash 2 and the pane 1.

Attachment of the first or border element to the glass sheet is achieved purely by the adhesive properties of the moulding material and is established during the moulding process. To achieve good adhesion the areas of attachment on the pane may be covered by a mask and/or be primed. The masking has the further purpose of contributing to the aesthetic value of the window and to protect adherents and the pane sealing 13 from sunlight. The mask is generally lightproof but must as a minimum be non-transparent for UV-A and UV-B light. The mask may be a ceramic coating, UV hardening lacquer, a one- or two-component lacquer or any other suitable material. It is to be understood that priming and masking may be achieved in one by the use of a material having properties suitable for both purposes.

However, for security reasons, for instance for the purposes of fire protection, a mechanical support may supplement the fastening provided by the moulding of the first or border element to the pane. One example of such a support is shown in FIGS. 2*c*, 2*e* to 2*g*, and 6*c*, but similar supports may be present in the other embodiments as well. The support 43 may be formed of any suitable material, which is preferably fireproof. One example is a metal rod that has been bent into the desired shape. In this manner, a connection between the pane and the window frame via the hinge connection is maintained, even in case the remaining material is burnt or melted, or if the structural and load-bearing capacity is deteriorated partly or in full. As a supplementary securing against deterioration of the sash 2 in the case of fire, a fire resistant or fire retardant filler may be mixed into the moulding material of the first element 4.

The provision of a second element 5 and further elements in the sash 2, in addition to the first element 4 moulded to the pane 1, may be chosen in correspondence with for instance different market requirements as to insulating properties, weather resistance and appearance. In the following, a limited but not exhaustive number of further elements will be described.

In FIG. 2*c*, which describes an embodiment, which is particularly advantageous as regards the insulating properties, said at least one further element includes an insulating element 6 positioned on the outer side of the first element 4. As this further element is in general not visible from the interior, at least not in the closed or only slightly opened condition of the window, and is not required to contribute to the structural strength of the sash, a material for the insulating element may be chosen only to optimise the insulating properties of the window. In turn, this opens a considerably increased choice in materials, as most insulating materials have a low density and consequently a lower structural strength. Furthermore, an external element 7 positioned on the external side of the first element 4 is provided. The external element 7 may be formed as a traditional cover connected to the exterior functional face of the first element of the sash. The cover may provide additional shielding against the penetration of weathering to interior parts of the window, or may be chosen to adapt the window to the surroundings, for instance in cases where the window is utilised as a replacement window in an array of conventional windows. In order to increase the insulating capacity even further, the window frame 3 is provided with a supplemental insulating frame 33.

In FIG. 2*e*, which shows a further development, which is particularly applicable in areas requiring a high degree of insulation and soundproofing, said at least one further element includes an internal element 8 positioned on the internal side of the first element 4, said internal element 8 including a supplemental sheet 14 of glazing material. The internal element 8 may for instance be connected to the first element 4 by a protruding flange 4*a* thereof extending into a recess 8*a* of the interior element 8. The first element 4 may have a supplemental rod-shaped attachment part 45, cf. also the embodiment of FIG. 2*g*, and the corresponding part 245 of the embodiment of FIG. 6*c*.

The number and configuration of further elements may vary, and several combinations and further developments of the examples given in the above are conceivable. One example is the provision of an external element including a supplemental sheet positioned externally of the pane 1. Such an external element may be provided with ventilation means, either passive means or active means sucking air from the outdoors. The internal element 8 may be provided with ventilation means as well.

Figure 3:
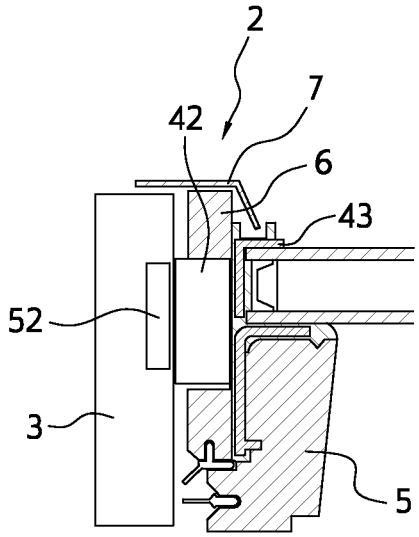
FIG. 3 is a cross-sectional view taken along the line III-III of FIG. 1.
Figure 4:
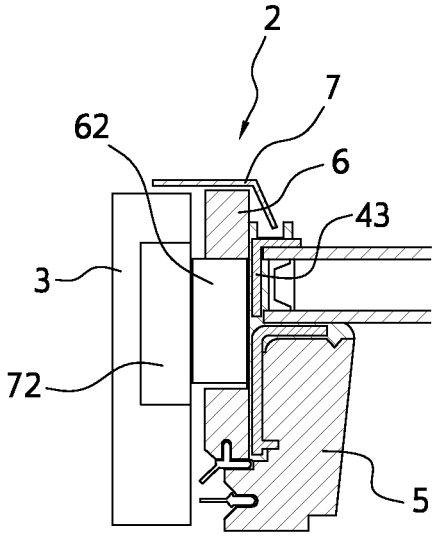
FIG. 4 is a cross-sectional view taken along the line IV-IV of FIG. 1.

Referring now to FIGS. 3 and 4, showing cross-sectional views of the window shown in FIG. 1 in the embodiment corresponding to FIG. 2*c*. Although the first element 2 of the sash is only required to transmit the forces via the hinge connection, further arrangements including load-transmission may be applicable. In one embodiment, the top piece 2 of the sash is provided with a locking assembly 42 for cooperation with corresponding means 52 in the frame top piece 3. In another embodiment, the bottom piece of the sash 2 is provided with operating means 62 for opening, positioning and/or closing of the sash relative to the window frame, the operating means being connected to a window operator 72 mounted in the bottom frame piece 3.

The first element 4 may be connected to the second element 5 and any other further elements by means of any detachable or undetachable connecting means. Examples of detachable connecting means are screws, nails or other mechanical connection means, e.g. a click-system. Examples of undetachable connecting means are moulding (for instance in the same process step as the moulding of the first element to the pane), glue or adhesives. Examples of click systems are shown in FIGS. 6*a* and 6*b*.

Figure 6A:
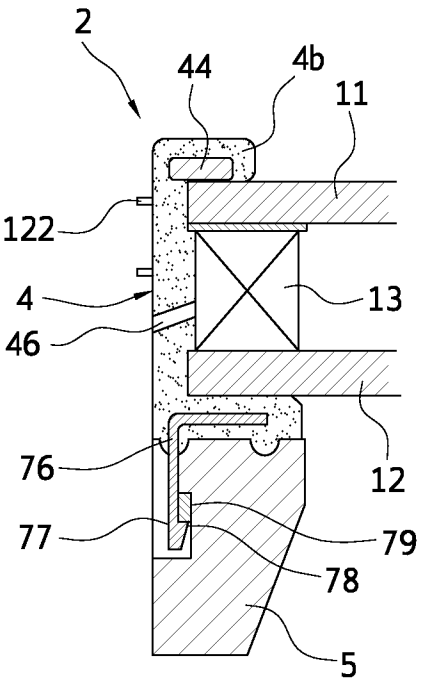

In FIG. 6*a* the first or border element 4 encases the exterior glass sheet 11, the distance profile and pane sealing unit 13, as well as the interior glass sheet 12. A fitting 76 embedded in the first element 4 has a tongue 77 with a barb 78, which engages with a catcher 79 on the second element 5. As in the above embodiment and the embodiments to be described in the following the pane element includes glass sheets, which may be parallel or non-parallel plane sheets, or sheets having an arbitrary shape.

The system depicted in FIG. 6*b* corresponds to the one in FIG. 6*a* as regards the overall configuration of the pane 1, first element 4, and second element 5. In this case, however, the second element 5 is provided with a fixation bushing 89 arranged to engage with a hole 88 in the projecting part 87 of the fitting 86. By turning the fixation bushing over 180 degrees, the tongue is engaged or disengaged. A screw 90 is used for fastening the bushing 89 in the second element 5 upon engagement of the tongue.

The connection between the first element and the frame is made in a manner that creates a watertight connection or at least so that moisture and water may be drained off in a controlled manner.

In the embodiment of FIG. 6*a*, one example of providing a durable protection against the penetration of water is shown.

A sealing strip 44 of any suitable material, for instance butyl rubber, is moulded into a nose portion 4*b* of the first element 4. The sealing strip 44 thus covers the outer corner of the external sheet 11.

Additional draining means may, however, be required. Referring still to FIGS. 6*a* to 6*c*, the design of three different draining techniques will be described further:

In FIG. 6*a*, a channel 46 extends from the edge of the pane 1 to the outer side of the first element 4 of the sash 2. In this manner, water penetrating through any sealings and covers may be safely drained from the pane edge.

In FIG. 6*b*, the drain includes a gel 147*a* located in a space 147 within the first element of the sash. The gel 147*a* is able to absorb water during humid conditions, and to allow the water to evaporate during dry spells.

In FIG. 6*c*, the drain includes a circumferential drain 246 extending along the edge of the pane 1 and within the first element 4 of the sash 2. The circumferential drain 246 may be provided with a number of openings 246*a* to allow entry of water into the circumferential drain 246. In this embodiment, a gasket 248 is furthermore provided between the interior glass sheet 12 and the second element 5 for relieving the border of the pane and for draining off condensation forming on the inside of the pane, preventing it from reaching the first element 4 and pane sealing/spacer profile 13. The sash 2 in this embodiment furthermore comprises a tongue-like weather strip 249 formed integrally during the moulding for tightening the space between the sash 2 and the window frame (not shown in this Figure). Additional draining may be provided by a projecting feather, preferably running along the entire length of the first element. The feather will prevent water from running from the exterior surface of the pane into the space between the sash and the window frame. At the lower end of the window the feather should be left out or interrupted to allow rainwater and the like to drain off unobstructed.

The pane is usually composed of monolithic glass sheets, in the embodiments of FIGS. 2*a* to 2*f* forming two sheets 11 and 12. In this context the term "monolithic glass" covers annealed glass, tempered glass, laminated glass, wired glass, figured or patterned glass as well as other types of glass that are used in conventional panes. Even if referred to as being made from glass, it is to be understood that Plexiglas (also known as Perspex) or any other sheet of glazing material, transparent or not, which is suited for the particular use of the window, may also be employed, including luminescent materials. Referring to FIG. 2*f*, the glass may have coatings on one or both sides. When making a step unit pane in this manner, a space 16 remains between the first or border element and edge of the non-encased glass sheet, allowing the introduction of a caulking device for the purpose of establishing a secondary pane sealing. The weight of the pane depends on a number of factors, including the choice of material, the size of the window, the number of sheets and the thickness of the individual sheets. These parameters are chosen in accordance with a number of factors, including the degree of insulating properties desired, both as regards soundproofing and thermal insulation. In a mid-size window having two sheets of glass, the weight of the pane 1 and the sash 2 may be 10-20 kg, whereas the corresponding sash-pane unit of a window having three sheets of glass may amount to above 25 kg. Conversely, in a window having a glazing consisting solely of a lightweight plastic material, the weight may be as low as 2-5 kg.

The cavity between the sheet elements may be filled with dry air, gas such as Ar, Kr or Xe, or with gas mixtures suitable for improving the insulating properties of the pane by reducing its U value. A vacuum pane may also be used as may a pane with a layer of aerogel filling the space between the sheet elements.

The pane may be a conventional type pane, where all sheet elements have identical size and shape, or may be a step unit. Step units are panes, where the different glass sheets have different height and/or width so that one sheet projects over another at least at one edge thereof. Also panes comprising three or more sheet elements, such as for example three-sheet thermo panes, may be used as may combinations of different pane types such as a traditional thermo pane in combination with a single sheet pane.

If using a pane type that can best be made in relatively small units, such as vacuum panes, a series of pane elements may be arranged side-by-side for the formation of a larger element of the desired size. This method may also be used for providing different areas of the pane with different properties such as colour, opacity, insulation etc.

The distance profiles or spacer members may be made from metal or plastic. A desiccant may be deposited in hollow distance profiles, embedded in a matrix or in a getter element in each of the cavities delimited by the glass sheets and the distance profiles. This may be carried out as a part of the pane module manufacture or the different elements may be pre-manufactured. Moreover, the distance profile may be provided with additional functionalities, such as sound dampening features, or additional members providing such functionalities may be provided in between the sheet elements of the pane(s).

The pane may be a conventional type pane, in which all glass sheets have identical size and shape, or may be step units. Step units are panes, where the different glass sheets have different height and/or width so that one sheet projects over another at least at one edge thereof.

A two-sheet pane may be constructed simultaneously with the moulding of the first element, in which case the distance profile may be made as an integral part of the first element or border element. The same applies if combining different pane types such as a two-sheet pane with a single-sheet pane; the two-sheet pane may then for example be made in a traditional manner whereas the distance member keeping it apart from the single-sheet pane may be a moulded projection on the border element. Either type of distance profile may be provided with projecting fittings or other means of attachment to the border element.

Figure 5:
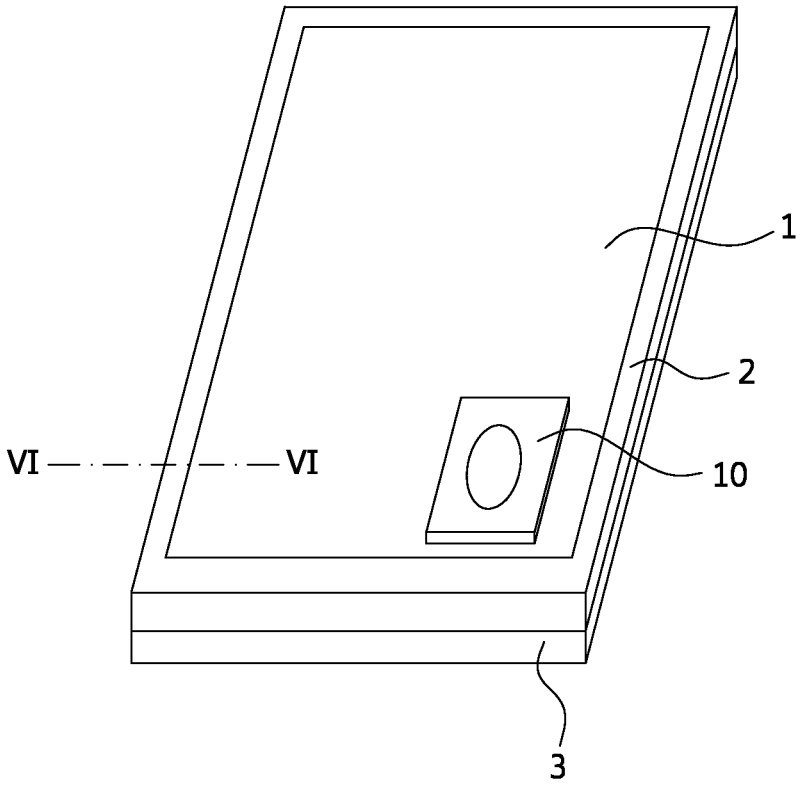
FIG. 5 is a perspective view of another window according to the invention.

Although the invention described in the above and shown in the drawings is referred to as a window, the invention is applicable to other closures for apertures in a building structure. Such closures may comprise panels including solar cells, photovoltaic elements etc. As indicated in FIG. 5 of the drawing a ventilation device 10 may be incorporated into the pane 1. The ventilation device 10 may be powered by for instance solar cells or photovoltaic elements in the pane 1, and be operated by control means moulded into the first element 4 or positioned elsewhere in the window.

The invention should not be regarding as being limited to the embodiments described and shown. Several modifications and combinations may be carried out within the scope of the claims.

The invention claimed is:

1. A window for a building structure having an interior and an exterior, comprising a window frame, a sash and a pane including at least one sheet of glass or other glazing material, said sash being moveable relative to the frame by means of a hinge connection including a set of frame hinge parts and a set of sash hinge parts, said sash carrying the pane, said sash including a first element surrounding the pane and formed as a moulded border element which at least partially encases an edge of at least one sheet of said pane, said first element having at least one functional face, and at least one further element connected to the first element at the at least one functional face thereof, the set of sash hinge parts of the hinge connection being directly connected to said first element at the at least one functional face thereof in such a manner that said first element is sufficient to transmit loads from the pane to the hinge connection, and that said further element has insulating properties and is selected from the group consisting of a second element and an insulating element; and, wherein said sash includes said at least one further element and the first element has an inner side facing the pane and an internal side adapted to face the interior of the building structure, and said further element is a second element positioned on at least one of the inner side and the internal side of the first element, wherein an outermost surface of the first element directly engages and extends along an inner surface of the hinge connection.

2. A window according to claim 1, wherein the first element has an outer side adapted to face the exterior of the building structure, and said further element is an insulating element positioned on the outer side of the first element.

3. A window according to claim 1, wherein the first element has an external side adapted to face the exterior of the building structure, and said at least one further element includes an external element positioned on the external side of the first element.

4. A window according to claim 1, wherein said sash comprises a top piece, a bottom piece and two side pieces, each of the pieces including a portion of the first element, and wherein said set of sash hinge parts is connected to the portions of the first element included in the side pieces of the sash.

5. A window according to claim 4, wherein each sash hinge part is integrally connected with the first element of the sash.

6. A window according to claim 4, wherein the top piece of the sash is provided with a locking assembly.

7. A window according to claim 4, wherein the bottom piece of the sash is provided with operating means for at least one of opening, positioning and closing of the sash relative to the window frame.

8. A window according to claim 1, wherein the window frame is provided with a supplemental insulating frame.

9. A window according to claim 1, wherein the pane has an external side adapted to face the exterior of the building structure, and a support is provided in the first element of the sash, said support being moulded into the first element and overlapping the external side of the pane slightly.

10. A window according to claim 4, wherein the pane has an external side adapted to face the exterior of the building structure, wherein a support is provided in the first element of the sash, said support being moulded into the first element and overlapping the external side of the pane slightly, and wherein the support is provided on at least two opposite side pieces of the sash or at the top piece and the bottom piece of the sash.

11. A window according to claim 9, wherein the support is connected to the set of sash hinge parts.

12. A window according to claim 1, wherein said at least one further element is detachably connected to the first element.

13. A window for a building structure having an interior and an exterior, comprising a window frame, a sash and a pane including at least one sheet of glass or other glazing material, said sash being moveable relative to the frame by means of a hinge connection including a set of frame hinge parts and a set of sash hinge parts, said sash carrying the pane, said sash including a first element surrounding the pane and formed as a moulded border element which at least partially encases an edge of at least one sheet of said pane, said first element having at least one functional face, and at least one further element connected to the first element at the at least one functional face thereof, the set of sash hinge parts of the hinge connection being directly connected to said first element at the at least one functional face thereof, and said further element has insulating properties and is selected from the group consisting of a second element and an insulating element and undetachable connecting means for undetachably connecting the first element to the pane, the undetachable connecting means being moulding, wherein an outermost surface of the first element directly engages and extends along an inner surface of the hinge connection, the inner surface of the hinge connection extending substantially perpendicular to the pane and the outermost surface of the first element extends between the interior and the exterior.

14. A window according to claim 13, wherein the further element is undetachably connected to said first element.

15. A window according to claim 1, wherein the at least one functional face of the first element includes a first functional face and a second functional face, the further element is connected to the first functional face of the first element and the hinge connection is directly connected to the second functional face of the first element.

* * * * *